US005618213A

United States Patent [19]

Nanami

[11] Patent Number: 5,618,213

[45] Date of Patent: Apr. 8, 1997

[54] TWIN IMPELLER DRIVE FOR JET PUMP

[75] Inventor: Masayoshi Nanami, Hamamatsu, Japan

[73] Assignee: Sanshin Kogyo Kabushiki Kaisha, Hamamatsu, Japan

[21] Appl. No.: 509,994

[22] Filed: Aug. 1, 1995

[30] Foreign Application Priority Data

Aug. 1, 1994 [JP] Japan ..... 6-180073

[51] Int. Cl.[6] ..... B63H 11/00

[52] U.S. Cl. ..... 440/38; 440/79; 440/80

[58] Field of Search ..... 440/38, 40, 41–43, 440/75, 80, 81; 416/128, 129

[56] References Cited

U.S. PATENT DOCUMENTS 3,044,260 1/1961 Hamilton ..... 440/75

3,601,989 8/1971 Austin ..... 440/75

FOREIGN PATENT DOCUMENTS

94/08845 4/1994 WIPO ..... 440/38

*Primary Examiner*—Jesus D. Sotelo

*Attorney, Agent, or Firm*—Knobbe, Martens, Olson & Bear LLP

[57] ABSTRACT

A jet propulsion unit for a watercraft that employs a pair of counter rotating impellers that are disposed immediately adjacent each other so that the need for straightening vanes is eliminated. The impellers are driven by a bevel gear transmission to rotate in opposite directions, which bevel gear transmission is contained within the jet propulsion unit outer housing but forwardly of the flow path of water therethrough. This bevel gear transmission is driven by a single input shaft through a flexible coupling.

16 Claims, 5 Drawing Sheets

TWIN IMPELLER DRIVE FOR JET PUMP

BACKGROUND OF THE INVENTION

This invention relates to a jet pump for a marine propulsion system and more particularly to an improved twin impeller, jet propulsion system.

The use of jet propulsion systems, frequently referred to also as "jet pumps," for powering watercraft is well known and well accepted. These units have a number of advantages over more conventional propeller driven watercraft.

The conventional type of jet propulsion unit most commonly employed includes an outer housing having a water inlet opening through which water is drawn. An impeller is disposed in the water inlet and is driven by an external prime mover for drawing water through the water inlet and discharging it through a discharge nozzle for providing a propulsion force. Normally these units employ a series of fixed straightening vanes behind the impeller for reducing the swirling action of the water discharged so as to improve the performance.

Although these units are quite effective, they do have some disadvantages. For example, when accelerating, there is a likelihood of cavitation occurring and this can significantly reduce the efficiency of the unit. Also, the straightening vanes provide a resistance to water flow and reduce the propulsion effectiveness of the unit.

It has been proposed, therefore, to employ a pair of impellers that rotate in opposite directions for pumping the water. However, the systems that have been previously proposed for this purpose have been quite complicated and not totally effective.

It is, therefore, a principal object of this invention to provide an improved twin impeller, jet propulsion unit for watercraft.

It is a further object of this invention to provide an improved, compact twin jet propulsion unit for a watercraft.

Some twin impeller, jet propulsion units have been proposed in which a reversing transmission is provided between the two impellers for effecting counter-rotation while permitting driving from a single prime mover. However, the provision of the transmission within the water flow path obviously either increases the size of the unit and/or decreases the effective pumping area for a given volume.

It is, therefore, a still further object of this invention to provide an improved compact transmission arrangement for a jet propulsion unit wherein the transmission is not disposed in the water flow path.

Another disadvantage of providing the transmission between the two impellers is that the impellers become spaced from each other and this may require or make desirable the use of straightening vanes between the impellers. In addition, the large difference in the distance between the impellers can also necessitate the use of straightening vanes in the discharge. Hence, one of the main advantages of using twin impellers is lost.

It is, therefore, a still further object of this invention to provide an improved twin impeller, jet propulsion unit for watercraft wherein the impellers are disposed immediately adjacent each other and the use of straightening vanes is substantially eliminated.

In many types of watercraft wherein jet propulsion units are employed, the watercraft itself is small and compact in nature. Therefore, there is not adequate room for separate driving arrangements for each of the impellers, nor is there room for large transmissions for driving the impellers in their opposite directions.

It is, therefore, a still further object of this invention to provide an improved, compact and single engine driven counter-rotating jet propulsion unit for watercraft.

SUMMARY OF THE INVENTION

This invention is adapted to be embodied in a jet propulsion unit for a watercraft that is comprised of an outer housing that defines a water inlet portion having a water inlet opening through which water may be drawn. The outer housing further defines a discharge nozzle through which water which has been pumped is discharged for generating a propulsion force. A pair of impellers are journaled within the outer housing in close proximity to each other for pumping water from the water inlet opening to the discharge nozzle. A transmission is disposed forwardly of the water inlet opening and outside of the water path through the jet propulsion unit for driving of the impellers in opposite directions.

DETAILED DESCRIPTION OF THE PREFERRED EMBODIMENT OF THE INVENTION

Figure 1:
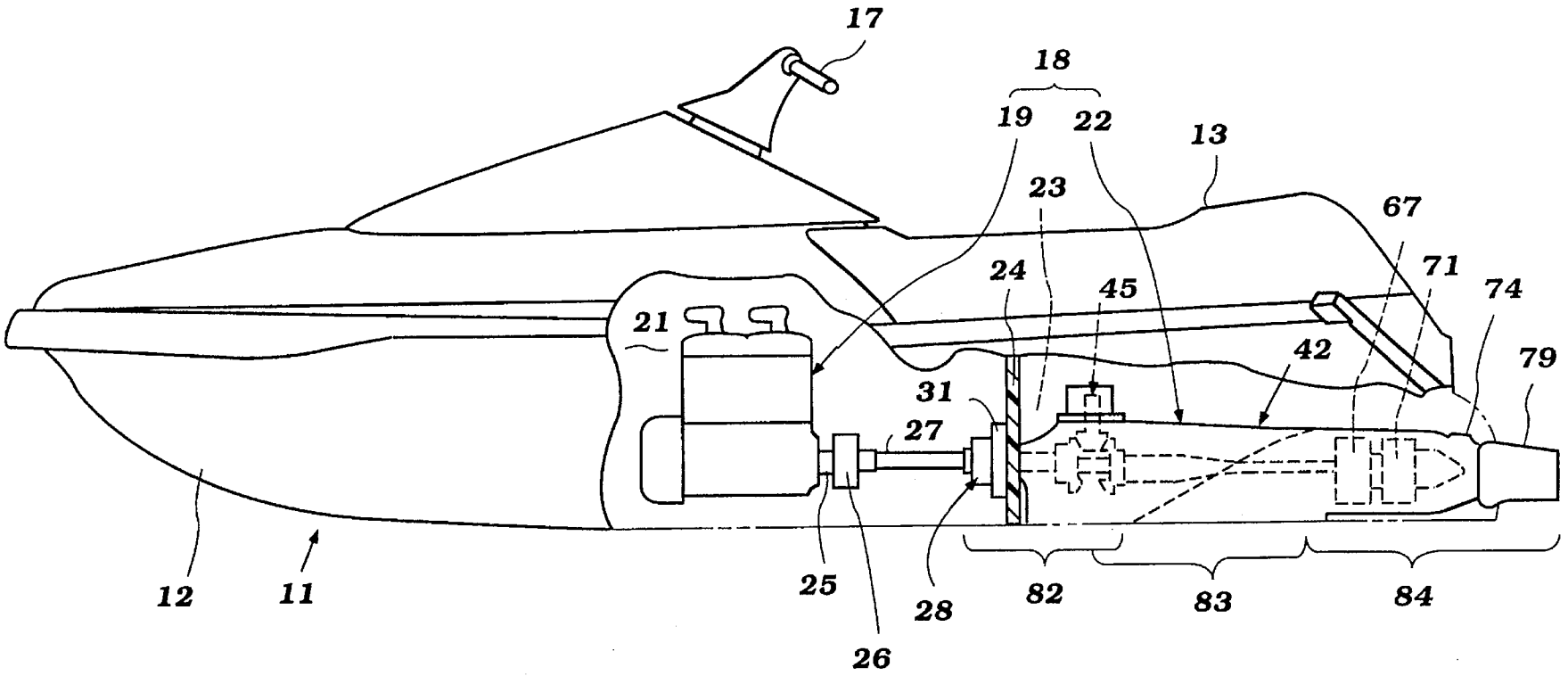
FIG. 1 is a side elevational view of a small watercraft constructed in accordance with an embodiment of the invention, with a portion broken away to more clearly show the construction.
Figure 2:
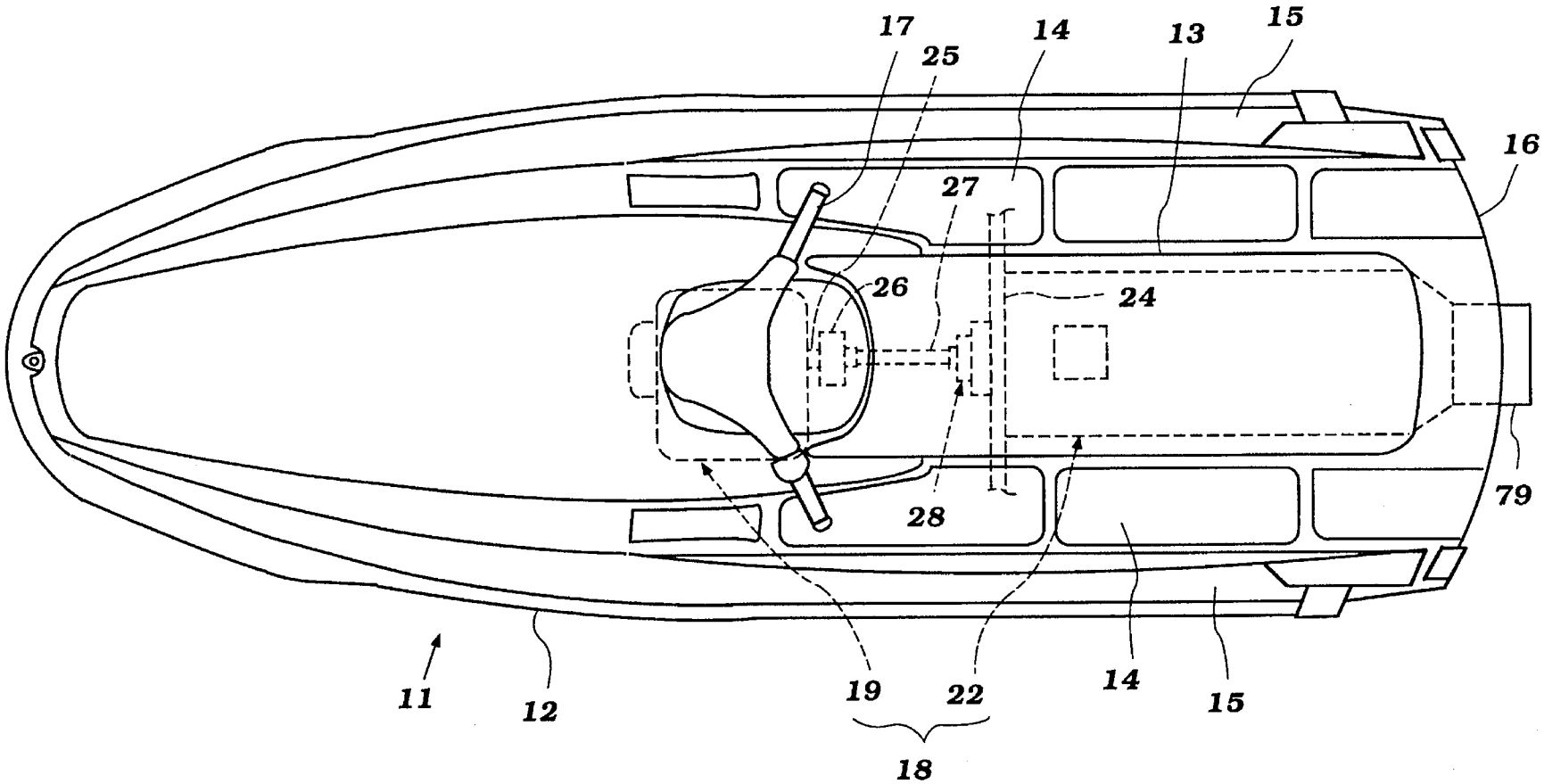
FIG. 2 is a top plan view of the watercraft.

Referring now in detail to the drawings and initially to FIGS. 1 and 2, a small personal watercraft constructed in accordance with an embodiment of the invention is identified generally by the reference numeral 11. The invention is described in conjunction was one of the many types of personal watercraft with which the invention has particular utility. It is to be understood that the invention is not limited to the application of the invention to this particular type of personal watercraft nor is it limited to personal watercraft per se. However, because of the compact nature and high efficiency of the unit, it has particular applicability to such watercraft.

The watercraft 11 is comprised of a hull assembly, indicated generally by the reference numeral 12 and which may be formed from a suitable material, such as a molded fiberglass reinforced resin or the like. The hull 12 has any suitable configuration and in the illustrated embodiment is provided at its rear portion with a raised pedestal seat 13 that is adapted to accommodate a rider-operator seated in a straddle fashion. If the rider-operator chooses to carry a passenger, the passengers will be seated in tandem fashion.

The portion of the hull 12 on the sides of the seat 13 is provided with foot areas 14 on which the riders and passenger or passengers may place their feet when seated on the seat 13. The outer peripheral edges of these foot areas are protected by raised gunnels 15. The rear of the passenger's compartment is open through the transom 16 of the watercraft 11 so that the watercraft may be easily boarded from the rear and from within the body of water in which the watercraft 11 is operating.

A control handlebar assembly 17 is disposed on the hull 12 forwardly of the seat 13 for operation by the foremost rider-operator. This control assembly 17 may be connected in a known manner to various of the propulsion unit controls in manners well known in this art. Some of these connections will be described later.

The construction of the watercraft 11 as thus far described may be considered to be conventional and, as has been noted, is only typical of one of the many types of watercraft with which the invention may be utilized. The invention deals primarily with the propulsion system for the watercraft 11 and this propulsion system is indicated generally by the reference numeral 18.

The propulsion system 18 is comprised in primary part of a powering internal combustion engine 19 that is supported within an engine compartment 21 that is disposed forwardly of and at least in part beneath the seat 13. The engine 19 may be of any type known in this art and in the illustrated embodiment as depicted as being of a two-cylinder, in-line type engine operating on a two-stroke crankcase compression principle. It will be readily apparent to those skilled in the art how the invention may be employed with any type of known engines.

The engine 19 drives a jet propulsion unit, indicated generally by the reference numeral 22, and which is constructed in accordance with an embodiment of the invention. The jet propulsion unit 22 is positioned within a tunnels 23 that is formed in the underside of the hull 11 and which is separated from the engine compartment 21 by a bulkhead 24.

Figure 3:
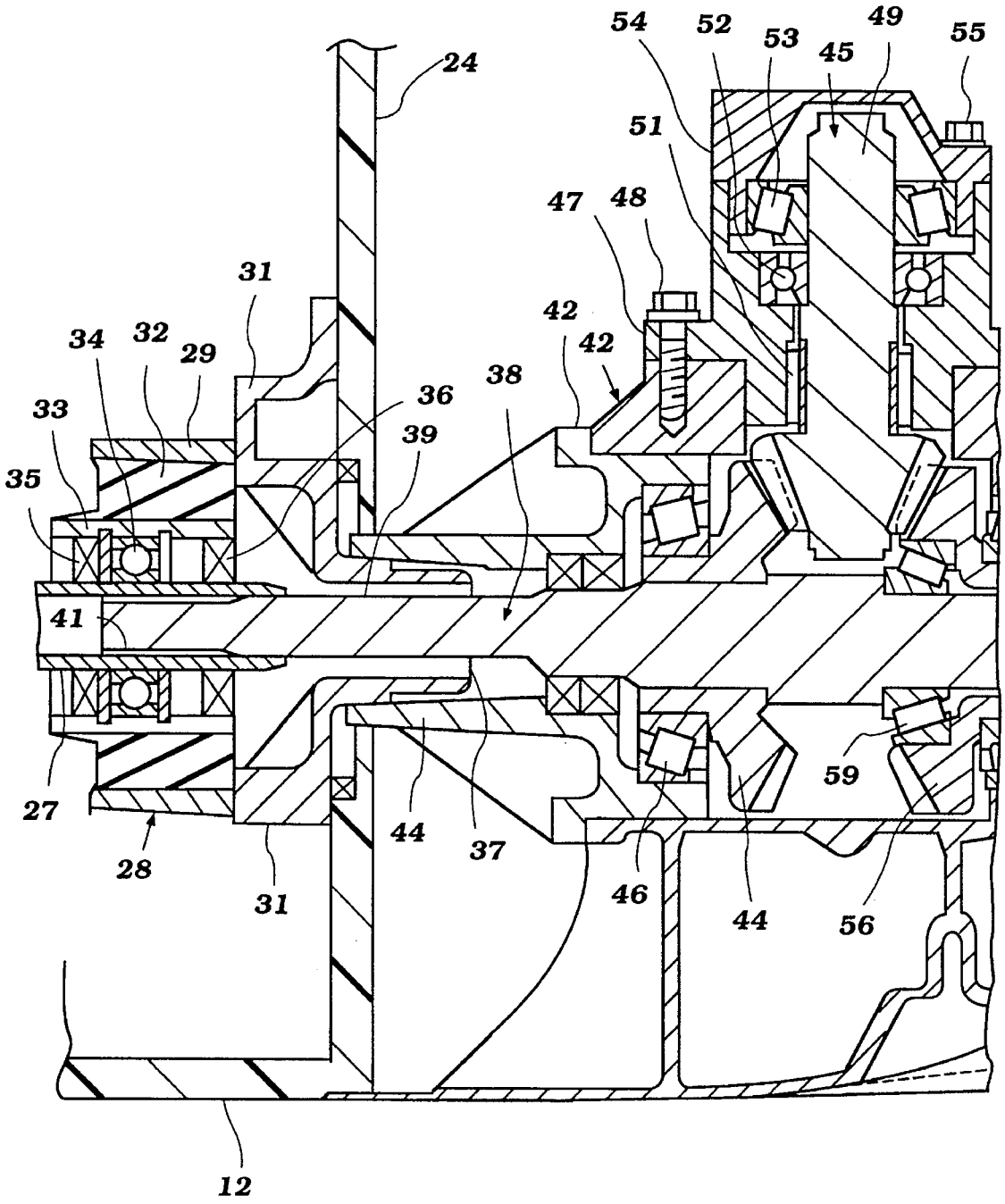
FIG. 3 is an enlarged cross-sectional view taken through the area where the drive shaft of the jet propulsion unit passes through the bulkhead and shows the reversing transmission for driving the impellers in their opposite directions.

The engine 19 is supported within the engine compartment 21 so that its output shaft, normally a crankshaft 25, rotates about an axis that lies in the longitudinal center plane of the hull 12. This engine output shaft 25 is coupled by means of a resilient coupling 26, of any known type, to an impeller drive shaft 27. The impeller-drive shaft 27 extends rearwardly and is supported at the bulkhead 24 by means of an elastic support, indicated generally by the reference numeral 28, and which has a construction as best shown in FIG. 3. This elastic support 28 is comprised of an outer sleeve 29 which is affixed to a mounting plate 31 which is, in turn, affixed to the bulkhead 24. An elastic sleeve 32 is bonded within the outer sleeve 29 and, in turn, has an internal bore in which an inner sleeve 33 is affixed by bonding. The inner sleeve 33 carries a ball bearing 34 that provides a rotational support for the rear end of the impeller drive shaft 27. Seals 35 and 36 are disposed on opposite sides of the bearing 34 for protecting it and for precluding water from entering the engine compartment 21 and/or damaging the bearing 34.

The mounting plate 31 has a pilot portion 37 that extends through the bulkhead 24 into the tunnel in which the jet propulsion unit 22 is positioned. A first impeller shaft 38 has a forwardly extending portion 39 that passes through the pilot portion 37 and is connected by means of a spline connection 41 to the impeller drive shaft 27 for establishing a driving relationship therebetween. It should be readily apparent that the flexible coupling 26 and resilient support 28 will accommodate some misalignment between the impeller shaft 38 and the impeller drive shaft 27. The spline connection 41 will also accommodate axial misalignments.

The jet propulsion unit 22 is comprised of an outer housing assembly, indicated generally by the reference numeral 42. This outer housing assembly includes a first closure plate 43 that has a forwardly extending pilot portion 40 which surrounds the mounting plate pilot portion 37 and extends into the bulkhead 24 Go provide a seal therebetween. The first impeller shaft 38 has an enlarged portion rearward of its front part 39 on which a first bevel gear 44 of a reversing transmission, indicated generally by the reference numeral 45, is affixed by a spline connection. A roller type thrust bearing 46 is received within the pilot portion 45 and journals the bevel gear 45 and this portion of the impeller shaft 38.

The reversing transmission 45 will be described by reference now to FIGS. 3 and 4 wherein it is shown partially in each figure. This transmission 45 includes a first housing piece 47 that is affixed to the jet propulsion unit housing 42 and which forms a portion of it. Threaded fasteners 48 are provided for this purpose. A pinion gear 49 has a shaft portion which is journaled by a needle bearing 51, a roller bearing 52 and a thrust bearing 53 mounted in the transmission housing piece 51 and a cover plate 54 that is affixed thereto by fasteners 55. The pinion gear 49 is in mesh with the bevel gear 44 ahd, thus, is rotatably driven by it at all times.

Figure 4:
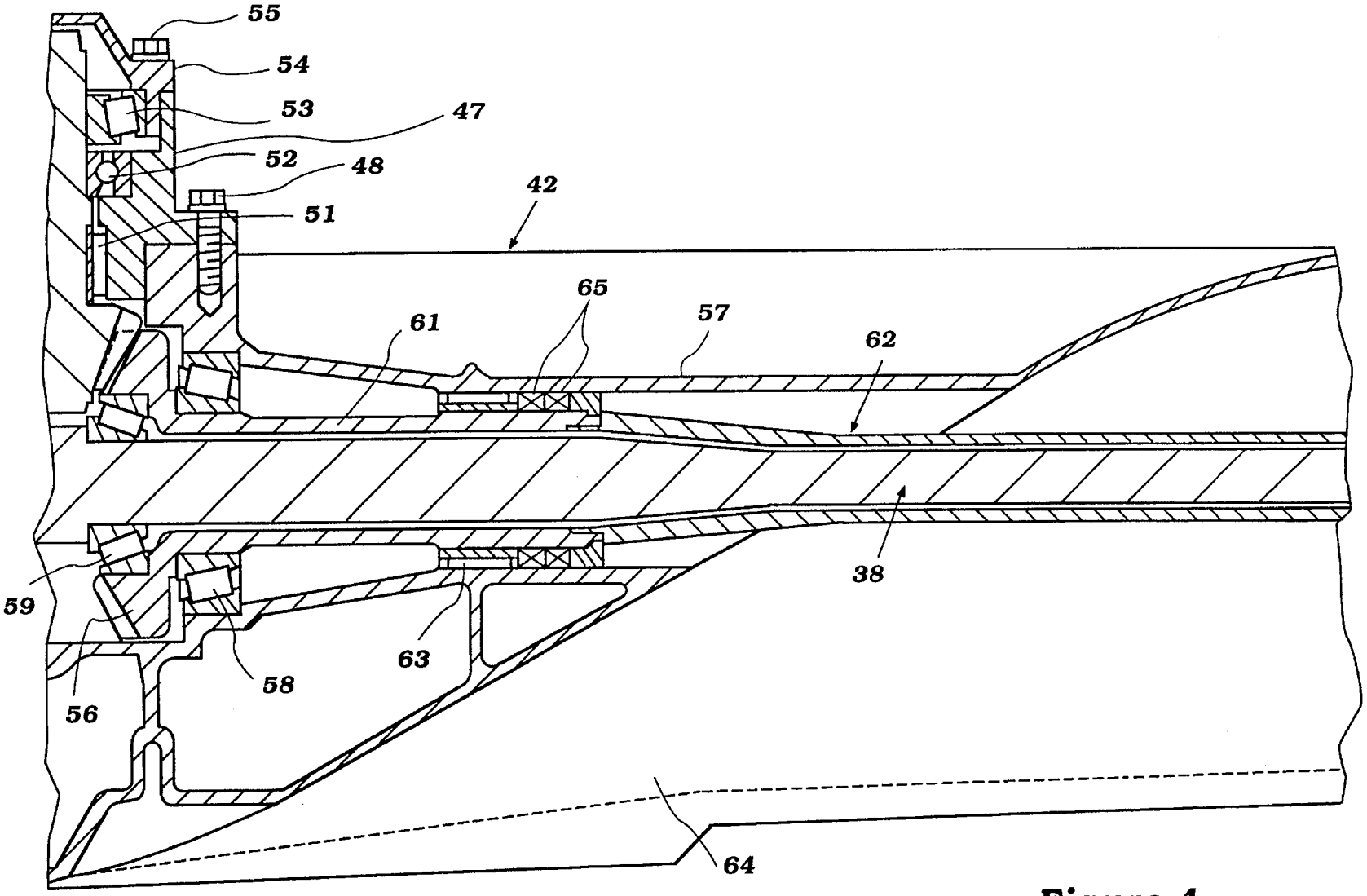
FIG. 4 is a cross-sectional view, which constitutes an extension of FIG. 3, and shows the two impeller shafts and how they enter into the jet propulsion unit.
Figure 5:
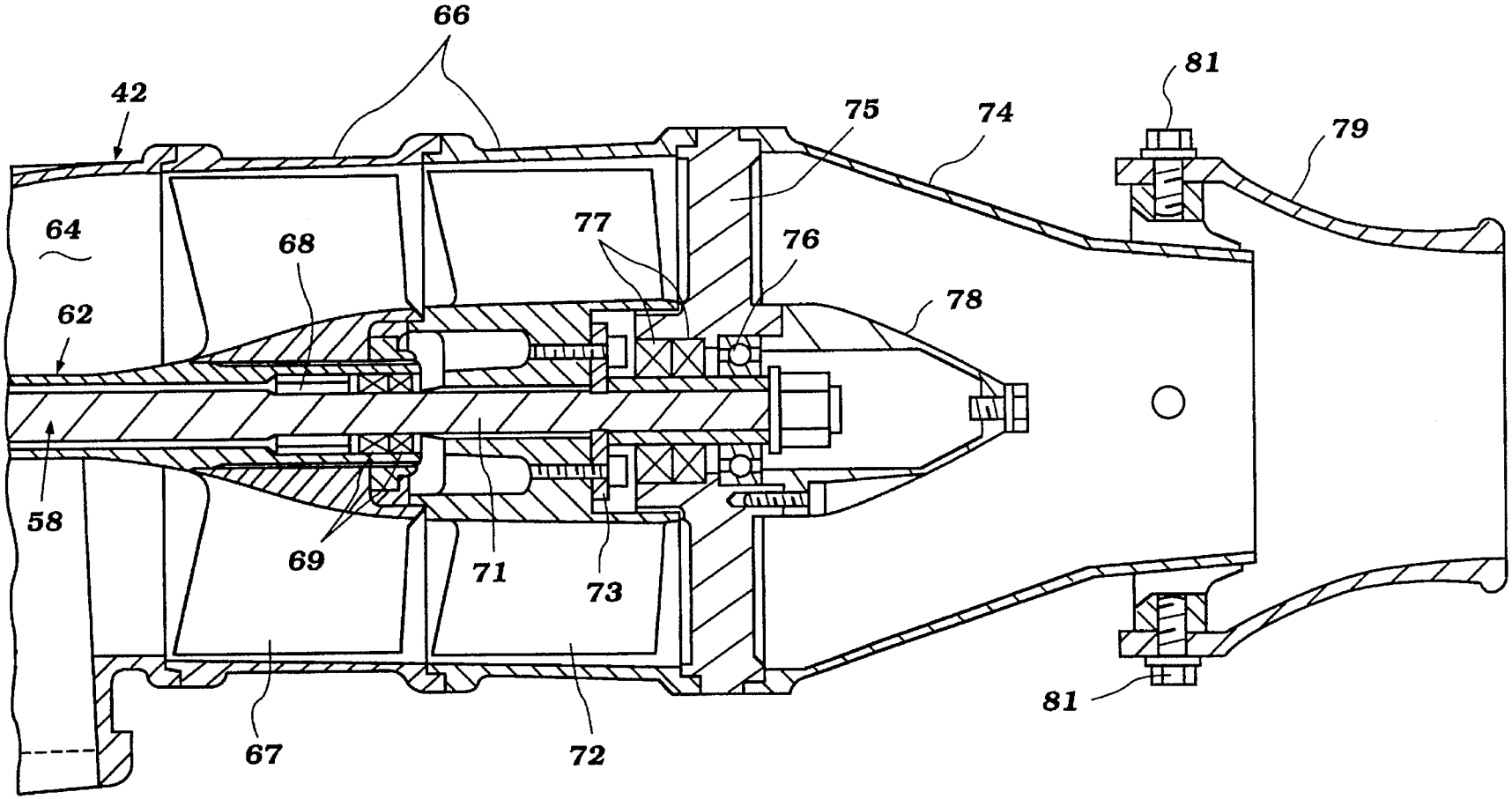
FIG. 5 is a cross-sectional view which constitutes a extension of FIG. 4 and shows how the impellers are driven.

Referring now primarily to FIG. 4, although a portion of the structure appears in FIG. 3, the pinion gear 49 is enmeshed with a further bevel gear 56 which is disposed diametrically opposite to the bevel gear 44 and, thus, rotates in an opposite direction from it. The bevel gear 56 is supported in a pilot portion 57 of the jet propulsion unit housing 42 by means of a first thrust bearing 58. In turn, the bevel gear 56 is journaled upon the impeller drive shaft 38 by a further thrust bearing 59. Hence, the first impeller drive shaft 38 is supported by the jet propulsion unit outer housing 42 via the bearings 59 and 58 and the bevel gear 56.

The bevel gear 56 has a shank portion 61 that has a splined or keyed driving connection to a second impeller drive shaft 62. The impeller drive shaft 62 is a hollow or tubular shaft telescopically received around the first impeller drive shaft 38.

These shafts are journaled by needle bearings 63 that are interposed between the pilot portion 57 and the bevel gear shaft portion 61. Immediately to the rear of the bearing 63, the impeller drive shafts 38 and 62 enter into a water inlet duct 64 formed by the jet propulsion unit outer housing 42. Therefore, water seals 65 are interposed around the pilot portion 57 adjacent the needle bearing 63.

It should be noted that where the impeller drive shafts 38 and 62 enter the water inlet duct 64, they have a reduced diameter. This is done so as to reduce the resistance to water flow through the water inlet duct 64. It should be noted that the water inlet duct 64 terminates in a downwardly facing opening so that water may be drawn into the jet propulsion unit 42 under the operation of the impellers, now to be described.

Rearwardly of the water inlet duct 64, the jet propulsion unit outer housing 42 is formed with an impeller housing that is formed by a pair of tubular impeller housing members 66. A first impeller 67 is affixed by a spline connection or the like to the trailing or rear end of the second tubular impeller drive shaft 62. At this area, needle bearings 68 are interposed between the rear end of the tubular impeller drive shaft 62 and the contained first impeller drive shaft 58. A pair of seals 69 are received in the open end of the tubular impeller drive shaft 62 so as to provide seals for the bearing 69.

The first impeller drive shaft 58 has a final reduced diameter portion 71 that extends beyond the end of the tubular impeller drive shaft 62 and to which a second impeller 72 is affixed for rotation, for example, by means of a splined connection. The impeller 72 is held on the impeller shaft 71 by a thrust arrangement 73 so as to permit the impellers 67 and 72 to operate in close proximity to each other without interference. As has been noted, the transmission 45 will cause the impellers 67 and 72 to rotate in opposite directions. The hand of the impellers is opposite so that they will effect axial flow of the water from the water inlet 64 rearwardly to a discharge nozzle 74 that is affixed to and forms the final portion of the jet propulsion unit outer housing 42 in a manner which will be described.

A bearing support plate 75, having an open, cruciform shape, is affixed between the discharge nozzle 74 and the impeller housing portion 66 in an appropriate manner. Because of its open cruciform shape, the plate 75 will permit free flow of water that has been pumped by the impellers 67 and 72 to the discharge nozzle 74.

A ball bearing 76 is mounted in the support plate 75 and supports the trailing end of the first impeller drive shaft 58. Water seals 77 are disposed between the impeller housing and the bearing 76 for their protection. In addition, a nacelle 78 is affixed to the support plate 75 and encloses the rear portion of the bearing 76 so as to maintain the area between them water tight.

Finally, a steering nozzle 79 is supported for pivotal movement about a vertically extending axis on the end of the discharge nozzle 74 by pivot bolts 81. The steering nozzle 79 is operated by the handlebar assembly 17 in a known manner, as by means of a bowden wire actuator or the like. This pivotal movement effects steering of the watercraft 11 as is well known in this art.

Referring now back to FIG. 1, it should be noted that the jet propulsion unit 42 is relatively compact and is comprised of a first forward portion 82 which establishes the driving connection to the drive shaft 27 in which the transmission 45 is contained. The bulk of the section 82 is disposed adjacent the bulkhead 24 and forwardly of the water inlet duct, which subtends a length indicated by the dimension 83 in this figure. Finally, the pumping stage comprised of the impellers 67 and 71 and the discharge portion comprised of the discharge nozzle 74 and steering nozzle 79 extends through a length 84 to the rear of the unit. Hence, the construction is quite compact and yet offers high efficiency through the use of its counter rotating impeller system. In addition, since the impellers are positioned close to each other due to the forward placement of the transmission 45, the unit operates with high efficiency and without adverse affects without requiring straightening vanes. Of course, if desired, such straightening vanes can be incorporated, for example, in the support plate 75.

It is to be understood that the foregoing description is that of a preferred embodiment of the invention and that various changes and modifications may be made without departing from the spirit and scope of the invention, as defined by the appended claims.

I claim:

1. A jet propulsion unit for a watercraft comprised of an outer housing comprising a water inlet portion through which water may be drawn from a body of water in which the watercraft is operating and a discharge nozzle portion through which the water is discharged for generating a propulsion force to the watercraft, a pair of impellers positioned between said water inlet portion and said discharge nozzle, and transmission means disposed forwardly of said impellers and out of the path of water flow through said water inlet for driving said impellers in opposite directions for pumping water from said water inlet to said discharge nozzle, said transmission means including a pair of telescoped shafts, each affixed to a respective one of said impellers within said jet propulsion unit, the inner of said telescoped shafts being journalled at its rear end within said outer housing, the outer of said telescoped shafts being journalled within said outer housing upon said inner telescoped shaft.

2. A jet propulsion unit for a watercraft as in claim 1, wherein straightening vanes are not positioned between the impellers.

3. A jet propulsion unit for a watercraft as in claim 2, wherein there no straightening vanes are provided in the discharge nozzle.

4. A jet propulsion unit for a watercraft as in claim 1, wherein the transmission means comprises a bevel gear transmission.

5. A jet propulsion unit for a watercraft as in claim 4, wherein the bevel gear transmission drives the telescoped impeller drive shafts.

6. A jet propulsion unit for a watercraft as in claim 5, wherein the impeller shafts comprise a tubular impeller shaft driven directly by one of said bevel gears for driving the forwardmost impeller and a second solid impeller shaft passing through said tubular impeller shaft and driving the aftmost impeller.

7. A jet propulsion unit for a watercraft as in claim 6, wherein the bevel gear transmission is disposed forwardly of and adjacent the water inlet portion and further including forward bearings contiguous to the water inlet portion for journaling the impeller shafts relative to each other and relative to the outer housing.

8. A jet propulsion unit for a watercraft as in claim 7, wherein the non-tubular impeller shaft extends forwardly through the outer housing for connection to a driving shaft for driving of the transmission, the bevel gear transmission further including an idler bevel gear supported for rotation about an axis extending transversely to the impeller shaft axes and disposed in an upper portion of the outer housing.

9. A jet propulsion unit for a watercraft as in claim 1, further including a single prime mover for driving the transmission through a flexible coupling.

10. A jet propulsion unit for a watercraft as in claim 9, wherein the transmission means comprises a bevel gear transmission.

11. A jet propulsion unit for a watercraft as in claim 10, wherein the bevel gear transmission drives the telescoped impeller drive shafts.

12. A jet propulsion unit for a watercraft as in claim 11, wherein the impeller shafts comprise a tubular impeller shaft driven directly by one of said bevel gears for driving the forwardmost impeller and a second solid impeller shaft passing through said tubular impeller shaft and driving the aftmost impeller.

13. A jet propulsion unit for a watercraft as in claim 12, wherein the bevel gear transmission is disposed forwardly of and adjacent the water inlet portion and further including forward bearings contiguous to the water inlet portion for journaling the impeller shafts relative to each other and relative to the outer housing.

14. A jet propulsion unit for a watercraft as in claim 13, wherein the non-tubular impeller shaft extends forwardly through the outer housing for connection to a driving shaft for driving of the transmission, the bevel gear transmission further including an idler bevel gear supported for rotation about an axis extending transversely to the impeller shaft axes and disposed in an upper portion of the outer housing.

15. A jet propulsion unit for a watercraft as in claim 14, wherein straightening vanes are not provided between the impellers.

16. A jet propulsion unit for a watercraft as in claim 15, wherein there are provided no straightening vanes in the discharge nozzle.

* * * * *